United States Patent [19]

Pawlowski et al.

[11] Patent Number: 4,775,771

[45] Date of Patent: Oct. 4, 1988

[54] SLEEVE FOR CRISPING AND BROWNING OF FOODS IN A MICROWAVE OVEN AND PACKAGE AND METHOD UTILIZING SAME

[75] Inventors: Thomas D. Pawlowski, Neenah; Richard K. Brown, Hortonville, both of Wis.

[73] Assignee: James River Corporation, Richmond, Va.

[21] Appl. No.: 79,420

[22] Filed: Jul. 30, 1987

[51] Int. Cl.[4] ..... H05B 6/80

[52] U.S. Cl. ..... 219/10.55 E; 219/10.55 F; 99/DIG. 14; 426/107; 426/243

[58] Field of Search ..... 219/10.55 E, 10.55 F, 219/10.55 R, 10.55 M; 99/DIG. 14, 451; 426/243, 241, 234, 107, 113, 114; 126/390

[56] References Cited

U.S. PATENT DOCUMENTS

| | | | |
|---|---|---|---|
| 3,394,007 | 7/1968 | Cambell | 426/107 X |
| 4,190,757 | 2/1980 | Turpin et al. | 219/10.55 E |
| 4,228,945 | 10/1980 | Wysocki | 426/113 X |
| 4,230,924 | 10/1980 | Brastad et al. | 219/10.55 E |
| 4,267,420 | 5/1981 | Brastad | 219/10.55 E |
| 4,448,309 | 5/1984 | Roccaforte et al. | 426/107 X |
| 4,553,010 | 11/1985 | Bohrer et al. | 219/10.55 E |
| 4,555,605 | 11/1985 | Brown et al. | 219/10.55 E |
| 4,612,431 | 9/1986 | Brown et al. | 219/10.55 E |
| 4,633,052 | 12/1986 | Beavers et al. | 219/10.55 E |
| 4,641,005 | 2/1987 | Seiferth | 219/10.55 E |

*Primary Examiner*—Philip H. Leung

*Attorney, Agent, or Firm*—Sixbey, Friedman, Leedom & Ferguson

[57] ABSTRACT

A microwave browning and crisping sleeve as well as a package assembly and method of microwave heating of food using the sleeve, wherein a paperboard strip has a microwave interactive layer affixed over one surface of the paperoard strip, the paperboard strip being subdivided by fold lines into at least five panel portions, wherein opposite ends of the paperboard strip are connected end-to-end in a manner creating a paperborad sleeve having the surface to which the interactive layer is fixed as its inner peripheral surface, and wherein the fold lines are disposed at positions which enable the sleeve to be erected and collapsed between a first configuration wherein the sleeve is flattened for shipping and storage, and a second configuration wherein the inner peripheral surface defines an open ended space for receiving a food product with top, bottom and side surfaces of the food product being in heat transfer relationship with respect to the microwave interactive layer. The package assembly comprises an outer package body defining an inner receiving space within which at least one sleeve and food item are disposed. In use, a food item and sleeve are removed from the package body, the sleeve erected and the food item inserted therein, after which the food in the sleeve is placed in a microwave oven and heated.

20 Claims, 4 Drawing Sheets

SLEEVE FOR CRISPING AND BROWNING OF FOODS IN A MICROWAVE OVEN AND PACKAGE AND METHOD UTILIZING SAME

BACKGROUND OF THE INVENTION

1. Field of the Invention

The present invention relates generally to microwave crisping and browning of foods via a disposable packaging element which will produce a heating effect when exposed to microwave energy, as well as packages and methods utilizing such elements.

2. Background Art

As manufacturers of prepared foods attempt to meet the marketplace demand for increasing numbers and varieties of prepared foods which can be heated in a microwave oven, they have experienced problems associated with enabling the product to be heatable in a microwave oven without resulting in areas that are either overcooked or undercooked, while also ensuring that the heated product will possess the desired degree of browning or crispness that such foods normally have when cooked in a conventional oven, particularly when the product is one requiring browning or crisping of multiple and nonplanar surfaces.

Various forms of specialized packages have been developed which are designed to achieve microwave browning of food cooked therein. Such packaging involves the use of a film or element that will convert microwave energy into thermal energy so as to produce a browning and/or crisping of an item of food situated in heat exchange contact therewith. In some cases the food is disposed within an outer package body that is used for shipping and storage as well as for heating of the food product. In other cases, the food is disposed on a tray-like member that is situated within an outer package body for shipping and storage, but is removed or rearranged relative to the outer package body when the food item is to be heated.

A first type of packaging that is used for both shipping and storage as well as heating of items of food is represented by Brastad U.S. Pat. Nos. 4,267,420 and Brastad, et al. 4,230,924. In these patents, flexible sheets of microwave interactive materials are wrapped closely about individual items of food so that when the package is exposed to microwave energy, at least a portion of the microwave energy impinging the package will be converted into heat for browning the surface of the food. However, such packages have been found to pose problems with various types of food which give off heat, grease or vapor. Furthermore, some irregularly shaped foods may be difficult to wrap without unacceptable bunching of the sheet material.

A second type of package that is used for both shipping and storage as well as heating of items of food is disclosed in Turpin, et al. U.S. Pat. No. 4,190,757. In the package and method in accordance with this patent, a microwave interactive layer is provided for contacting the underside of a food product and a second interactive layer may be provided to contact the top surface thereof, as well. The problem of venting of moisture is resolved through the provision of openings in the outer package body that are covered for shipping and storage purposes, but may be exposed for heating of the food product. However, for foods which do not have planar bottom or bottom and top surfaces, and food products requiring browning at side surfaces as well, uniform browning or crisping cannot be achieved with such a package. Likewise, due to the fixed configuration of the package body, for example, a package suitable for heating of a sandwich may not be suitable for heating of a turnover or pocket-type pie.

A cook-in package which not only deals with the problem of venting of foods which will give off grease or vapor during heating, but also deals with the problem of obtaining more uniform browning of foods on multiple nonparallel surfaces is disclosed in commonly assigned, copending U.S. application Ser. No. 829,227, filed Feb. 14, 1986. In this application, a package assembly is disclosed which includes a microwave interactive tray, having a bottom wall and one or more opposed side walls, is designed to have a nonrectangular cross-sectional configuration suited for closely conforming to the cross-sectional profile of a food product to be browned or crisped in it during heating in a microwave oven. Furthermore, for venting purposes, the tray is provided with vent openings and is open-ended. However, even though this package assembly is very effective for microwave heating of certain products, such as French bread pizzas, the tray of the package assembly cannot be utilized independent of the outer package body of the assembly and is not suitable for microwave heating of such products as waffles and sandwiches requiring browning of top as well as bottom and side surfaces thereof.

In U.S. Pat. Nos. 4,555,605, and Divisional Patent thereof 4,612,431, a package assembly and method for storing and microwave heating of food is disclosed which includes, as a component of the package assembly, a disposable tray having a microwave interactive layer thereon, which is usable independent of the outer package body of the package assembly. However, the tray of this package assembly is only suitable for obtaining browning or crisping of a substantially planar bottom surface of a food product.

Thus, there is a need for a packaging element which can be utilized independent of an outer package body, yet is still capable of browning top, bottom and side surfaces of a food product. Furthermore, for purposes of compactly packaging such an element within a package assembly, it is desirable that the element be collapsible from a configuration conforming to the shape of a food item to be heated therein to a generally flat configuration for shipping and storage purposes. Moreover, it is considered to be particularly desirable to achieve an element of the noted type which can be utilized with food items of both rectangular and nonrectangular cross-sectional profiles.

DISCLOSURE OF THE INVENTION

It is an object of the present invention to provide a microwave browning and crisping sleeve, as well as a food package assembly and method using same, wherein rectangular as well as nonrectangular foods may be crisped and browned at bottom, top and side surfaces thereof via a microwave oven and independent of any supporting outer package body.

It is a further object of the present invention to provide a microwave browning and crisping sleeve, as well as a package assembly and method utilizing same, wherein the sleeve, despite being made of paperboard and being erectable into nonrectangular, particularly irregular configurations, is collapsible into a flattened configuration for shipping and storage.

It is a specific object of the present invention to provide a microwave browning and crisping sleeve formed of a paperboard strip having a microwave interactive layer affixed over one surface thereof, and which is subdivided by fold lines into at least five panel portions in a manner which will enable a sleeve formed by an end-to-end joining of opposite ends of the strip, to be erected into rectangular and/or nonrectangular configurations and to be collapsed into a flattened configuration irrespective of the number of panel portions or erected configuration.

The above and other objects and advantages of the invention are achieved by a microwave browning and crisping sleeve in accordance with preferred embodiments of the present invention, as well as via a food package assembly and method of microwave heating packaged food utilizing same, wherein a paperboard strip has a microwave interactive layer affixed over one surface of the paperboard strip, the paperboard strip being subdivided by fold lines into at least five panel portions, wherein opposite ends of the paperboard strip are connected end-to-end in a manner creating a paperboard sleeve having the surface to which the interactive layer is fixed as its inner peripheral surface, and wherein the fold lines are disposed at positions which enable the sleeve to be erected and collapsed between a first configuration wherein the sleeve is flattened for shipping and storage, and a second configuration wherein the inner peripheral surface defines an open ended space for receiving a food product with top, bottom and side surfaces of the food product being in heat transfer relationship with respect to the microwave interactive layer. Conveniently, the fold lines may be formed by score lines produced by such known techniques as perforation, cut, or crush scoring.

In accordance with a form of the invention designed to enable the erected configuration of the sleeve to be either rectangular or nonrectangular in shape, four of the fold lines are disposed to define a generally rectangular array when the sleeve is erected and at least one additional fold line is disposed as a bisector of the sleeve between the respective pair of the four fold lines. The presence of the at least one additional fold line enables the erected configuration of the sleeve to be selectively either of a generally rectangular or a generally wedge-shaped, cross-sectional profile. Similarly, the provision of two additional fold lines disposed opposite each other adds the further capability of a hexagonally erected shape, with equal top and bottom halves, being obtained.

Additionally, in accordance with a broader concept, the shapes obtained by the foregoing embodiments and other, irregular polygonal, shapes can be achieved, in accordance with the present invention, by ensuring that two of the fold lines of the sleeve are positioned relative to each other in a manner dividing the sleeve in half so that the sum of the circumferential lengths of the panel portions disposed between the two fold lines in one half of the sleeve is equal to the sum of the circumferential lengths of the panel portions disposed between the two fold lines in an opposite half of the sleeve. In this manner, even though the number of panel portions between the two fold lines is different for each half of the sleeve, or the circumferential lengths of oppositely facing panel portions are unequal, the sleeve will be collapsible into a generally flat configuration. For example, a sleeve for use with a Kaiser roll sandwich having a bottom roll half that is more shallow than the top half, can be comprised of a sleeve having top and bottom halves that are each comprised of three panel portions, a central panel of the bottom half being larger than the central portion of the top half (reflecting the fact that the bottom of a Kaiser roll is flatter than the top), while the the side wall portions of the bottom half are shorter than the side wall portions of the top half (again reflecting corresponding differences in the circumferential profile of the bottom half of a Kaiser roll relative to its top half).

Due to the use of microwave browning and crisping sleeves in accordance with the present invention, a food package assembly is created wherein at least one microwave browning and crisping sleeve and at least one item of food can be compactly packaged within an outer package body with a minimum of wasted space, yet a method of microwave heating of the food can be achieved whereby the food and sleeve can be easily removed from the outer package body, the sleeve erected, and the food item arranged within the sleeve in heat transfer relationship with respect to the microwave interactive layer provided on the inner peripheral surface of the sleeve. Due to the fact that the sleeve configuration can be brought into heat transfer relationship with respect to a greater portion of the surface of the food product, uniform browning or crisping of the microwave heated product is achievable. On the other hand, the usefulness of the invention is increased by the ability of inventive sleeves to compensate for unavoidable variances in product dimensions which will occur from item to item of even the same food product type, and to be adapted for use with food products of more than one configuration.

Best Mode for Carrying Out the Invention

Figure 1:
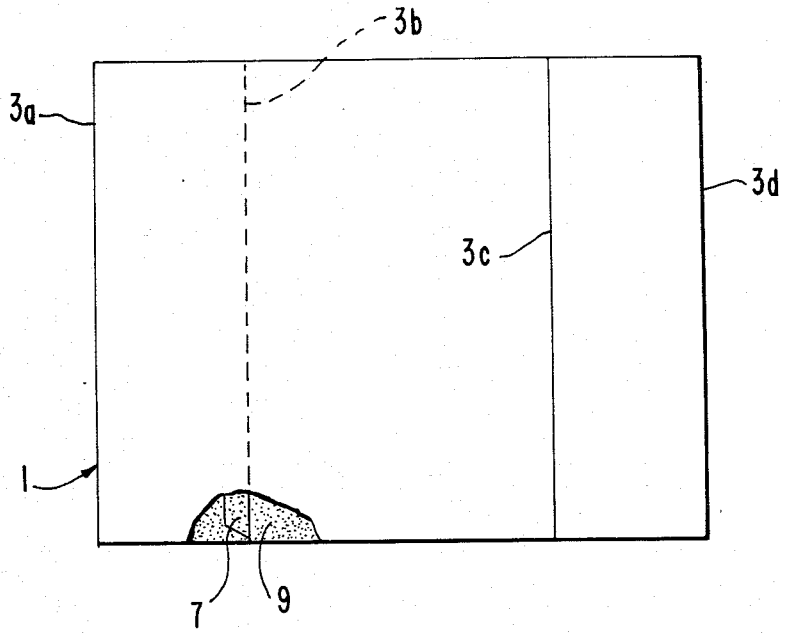
FIG. 1 is a top plan view of a collapsed microwave browning and crisping sleeve in accordance with the present invention, partially broken away to show an interior surface thereof.

In FIG. 1 a microwave browning and crisping sleeve is designated generally by the reference numeral 1 and is in the nature of a paperboard strip that has been subdivided by fold lines 3*a*–3*e* into a plurality of panel portions 5*a*–5*e* (FIG. 2), as well as an attachment flap 7 by which opposite ends of the paperboard strip may be connected in an end-to-end manner (such as by gluing of flap 7 to the opposite end panel portion) to create a paperboard sleeve. The fold lines 3*a*–3*e* may be produced by any conventional technique, such as perforation, cut, or crush scoring. Prior to connecting of the opposite ends of the paperboard strip, the surface thereof which will become the inner peripheral surface of the sleeve 1 is provided with a layer 9 of a microwave interactive material which, when subjected to a microwave energy, will operate to convert the microwave energy to heat in an amount sufficient to brown or crisp food surfaces that are in contact with or in close proximity to the microwave interactive layer 9. A suitable laminate which may be used on such a disposable paperboard sleeve is disclosed, for example, in U.S. Pat. No. 4,641,005.

Figure 2:
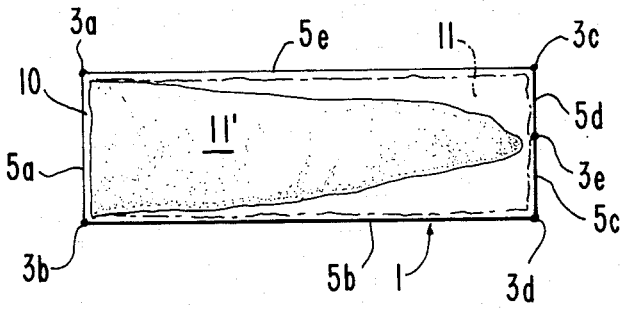
FIG. 2 is a diagrammatic end view of the sleeve of FIG. 1 in an erected configuration with one food product shown therein in solid lines and a second food product depicted therein in broken line form.

As can be seen from the drawing, four of the fold lines, 3*a*–3*d*, are disposed relative to each other along the sleeve 1 so that the sleeve can be erected, from the collapsed configuration of FIG. 1 (wherein the sleeve has been folded about diagonally opposite fold lines 3*a*, 3*d*), to the configuration of FIG. 2 wherein the fold lines 3*a*–3*d* define a generally rectangular array and the microwave interactive layer 9 on the inner peripheral surface of sleeve 1 bounds an openeded space 10 for receiving a food product 11 (shown in phantom) to be heated in a microwave oven (not shown). To achieve this configuration, sleeve 1 is erected without causing panel portions 5*c*, 5*d* to fold about the additional fold line 3*e*, so that, in effect, panel portions 5*c* and 5*d* form a single panel portion of the same size as oppositely facing panel portion 5*a*. In this configuration, the food product 11, which has a rectangular peripheral profile, can be browned or crisped effectively if heated within the sleeve 1 in a microwave oven due to the fact that substantially the entire circumferential extent of the food product 11 (such as a waffle or sandwich) would be in contact with or in close proximity to the microwave interactive layer 9 along the entire inner peripheral surface of the sleeve 1.

On the other hand, as can also be appreciated from FIG. 2, if a food product 11′ having a wedge-shaped configuration (such as a turnover or pocket pie) were to be disposed within a sleeve of a rectangular cross-sectional shape, at best, one or perhaps two surfaces of the food product 11′ would be in sufficiently close proximity to the microwave interactive layer 9 to achieve a proper browning or crisping effect when heated in a microwave oven. However, due to the presence of the additional fold line 3*e*, the sleeve, in accordance with the present invention, may be erected into the configuration shown in FIG. 3, wherein the open-ended space 10 for receiving the food product 11′ takes on a generally wedge-like shape that enables the microwave interactive layer 9 to be brought into contact or close proximity with the peripheral surface of the food item 11′ along its full circumference.

Furthermore, due to the fact that the paperboard panels 5*a*–5*e* possess some flexibility and since the extents to which each of the adjacent pairs of panel portions may be folded with respect to each other about an interconnecting fold line may be varied, unavoidable dimensional variations from one food product to another of the same type may be easily accommodated without any adverse impact upon the ability of the sleeve 1 to achieve its intended browning or crisping effect. It also should be appreciated that, even though the fold line 3*e*, as shown in FIG. 2, is disposed as a bisector of the sleeve between the pair of fold lines 3*c*, 3*d*, this fold line could be shifted toward or away from fold line 3*c* if food products of an assymetrical cross-sectional shape were sought to be accommodated, and such a change would not affect the ability of the sleeve 1 to achieve the collapsed configuration of Fig. 1 since fold line 3*e* is inactive in the collapsed condition of the sleeve 1, i.e., panel portions 5*c*, 5*d* present the appearance of a single flat panel in the collapsed configuration of sleeve 1, as shown in FIG. 1.

Figure 3:
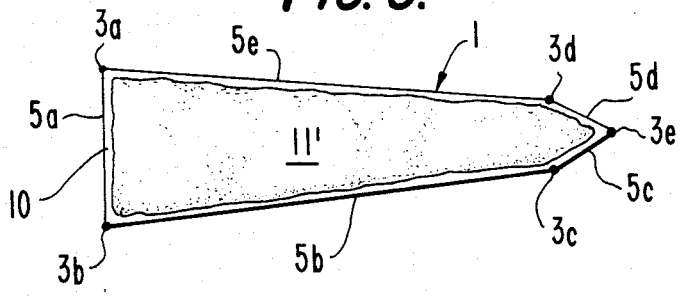
FIG. 3 is a view, similar to FIG. 2, but with the sleeve in a second erected configuration.
Figure 4:
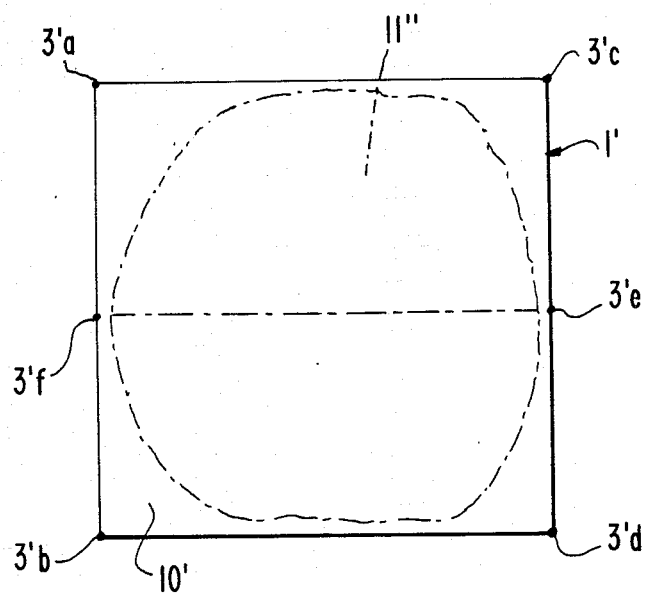
FIG. 4 is a view similar to FIG. 2 of a second microwave heating and browning sleeve with a food product depicted therein in broken line form.

As can be appreciated from FIG. 4, other food products, which have a nonrectangular cross-sectional shape, such as sandwiches formed on a roll or bun or French bread type loaf, also present a peripheral surface which, if inserted within a rectangular receiving space, would have a major extent thereof disposed too far from a microwave interactive layer that is on the boundary walls thereof to be effectively browned or crisped thereby when heated in a microwave oven. Thus, for such food products 11″, a microwave browning and crisping sleeve 1′ may be utilized which has, besides the fold lines 3′*a*–3′*d* (that can be arranged in a rectangular array) and the additional fold line 3′*e*, a second additional fold line 3′*f* which is provided opposite additional fold line 3′*e*. Additional fold line 3′*f* serves to subdivde the panel portion corresponding to panel portion 5*a* of the embodiment of FIGS. 1–3 into a pair of panel portions $5'a_1$ and $5'a_2$.

Figure 5:
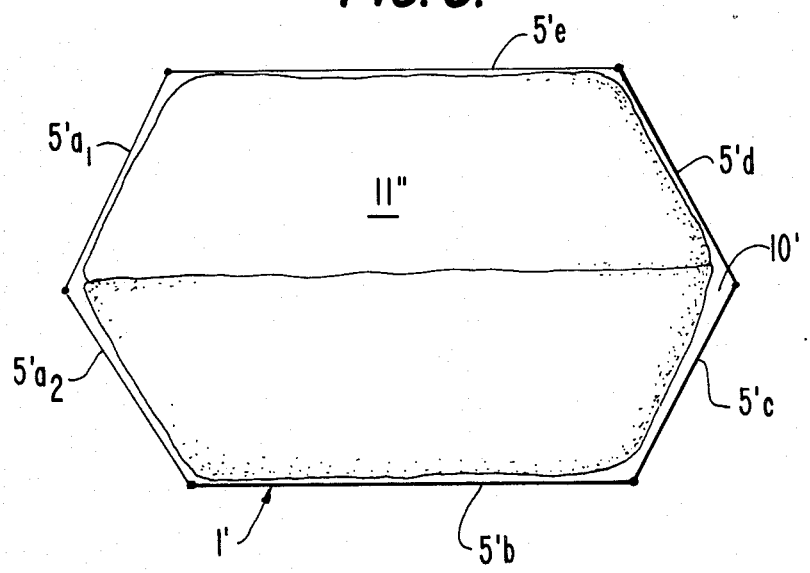
FIG. 5 is an end view of the sleeve of FIG. 4 in a second erected configuration and with a food product disposed therein.

The modified microwave browning and crisping sleeve 1′ may be erected into a configuration, as shown in FIG. 5, wherein a receiving space 10′ for the food product 11″ is provided that has the shape of an irregular hexagon having relatively large top and bottom walls 5′*e*, 5′*b*, and four relatively smaller side walls arranged in oppositely angled pairs $5'a_1$, $5'a_2$, and 5′*c*, 5′*d*. Furthermore, it should be appreciated that, in the same manner that the wall 5*a* of the embodiments of FIGS. 1–3 was subdivided in going from that embodiment to the embodiment of FIGS. 4 and 5, any one or more of the panel portions of either of these embodiments may be further subdivided to give a greater ability of the sleeve to adapt to the peripheral surface profile of various different food products without affecting the ability of the sleeve to be collapsed into a flattened configuration about a diagonally opposite pair of fold lines 3*a*–3*d* or 3′*a* –3′*d*.

Figure 6:
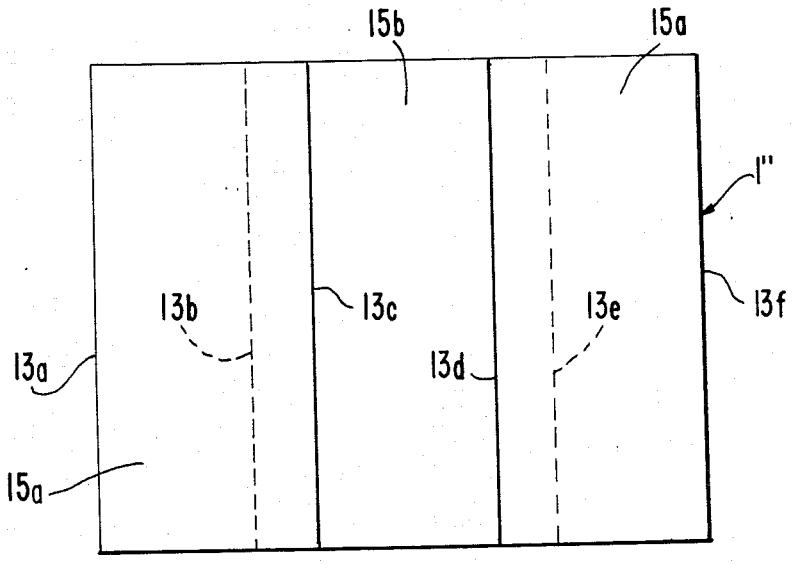
FIG. 6 is a top plan view of another microwave heating and browning sleeve in accordance with the present invention shown in a partially erected configuration.
Figure 7:
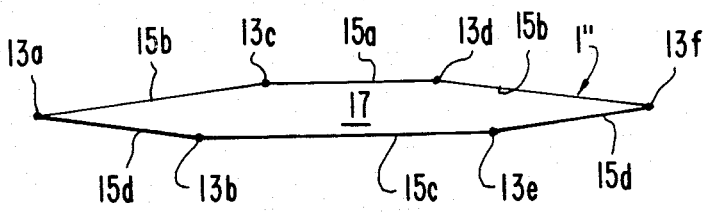
FIG. 7 is a diagrammatic end view of the partially erected sleeve of FIG. 6.
Figure 8:
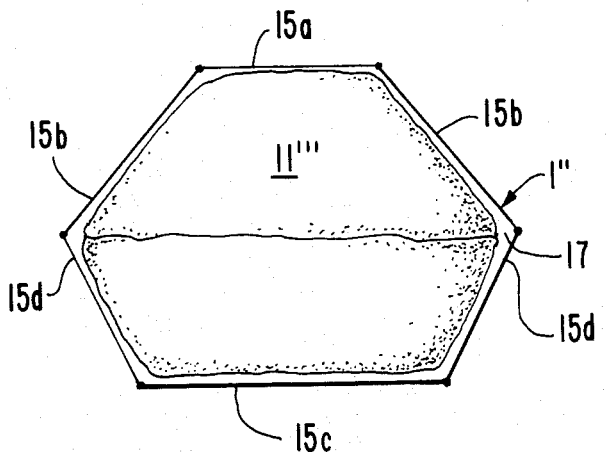
FIG. 8 is a view similar to FIG. 6, but after the sleeve has been fully erected and an item of food arranged therein.

However, some food products, because of their shape, are not suitable for use with sleeves that have been modified from a basic rectangular cross-sectional shape, as could be said to be the case with regard to the sleeve used as shown in FIGS. 3 and 5. For example, a sandwich made on a roll might have a bottom part with a peripheral surface that is flatter and more shallow than its top part. In such a case, a microwave browning and crisping sleeve 1″ as shown in FIGS. 6–8 is usable. As illustrated, the sleeve 1″ is formed with six fold lines 13*a*–13*f*, the fold lines 13a and 13f being disposed relative to each other in a manner which divides the sleeve 1″ in half. In the top half of the sleeve, the fold lines 13*a*, 13*c*, 13*d* and 13*f* subdivide the sleeve into a central panel portion 15*a* and a pair of side panel portions 15*b*. Similarly, fold lines 13*a*, 13*b*, 13*e*, and 13*f* subdivide the lower half into a central panel 15*c* and a pair of side panels 15*d*. As also can be seen, the top central panel 15*a* is smaller than the bottom central panel 15*c* and the pair of adjoining side panels 15*b*, while the pair of lower side panel portions 15*d* are smaller than all of the other panel portions. As a result, the receiving space 17 has a lower half that is broader and shallower than the top half, enabling the sleeve to conform with the similar disparities in size of the top, bottom and side surfaces of the food product 11'''.

Figure 9:
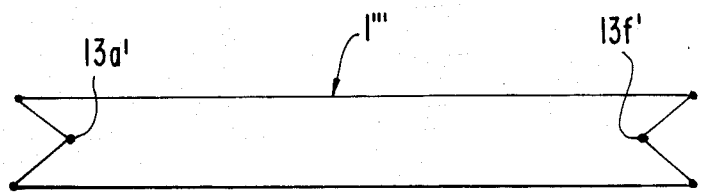
FIG. 9 is a diagrammatic end view of a sleeve having inward, pleat-like folded, sidewalls.

However, despite the disparities between the sizes of the individual panel portions disposed opposite each other and adjacent each other, sleeve 1'' can define an internal receiving space 17 that can be as varied in shape as that existing between the slightly erected configuration of FIG. 7 and the almost fully erected configuration shown in FIG. 8. Furthermore, the sleeve 1'' can be fully flattened as well, due to the fact that the sum of the circumferential lengths of the panel portions disposed between the fold lines 13*a* and 13*f* in one half of the sleeve is equal to the sum of the circumferential lengths of the panel portions disposed between these two fold lines in the opposite half of the sleeve. In fact, it has been determined that so long as this governing principle of having a pair of fold lines disposed along the sleeve so as to subdivide the sleeve into two halves that are circumferentially equal in length is followed, the sleeve can be provided with panel portions in each half of any number of panel portions desired and any combination of circumferential lengths desired. Also, instead of having outwardly folding side walls (such as shown on the right-hand side in FIG. 3 and in FIG. 7, for example), the side walls may be folded inwardly creating a pleat-like fold, such being particularly useful for relatively flat and narrow food objects. A sleeve 1''' with pleat-like folds 13*a*', 13*f*' is shown in FIG. 9. As a result, a sleeve constructed in accordance with this principle affords infinite possibilities for adapting a paperboard sleeve to the peripheral profile of a particular product to be heated within it in a microwave oven.

Figure 10:
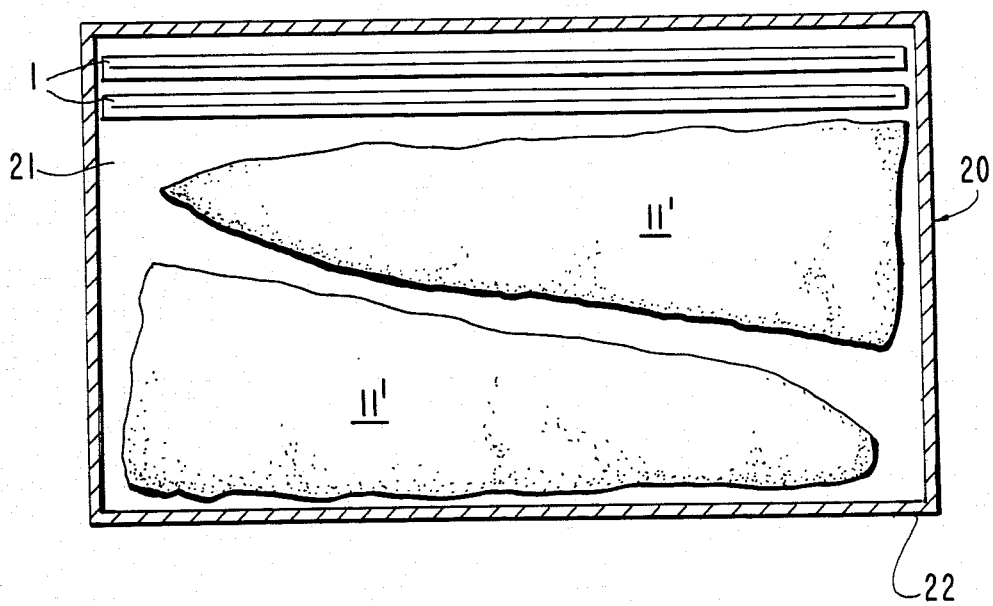
FIG. 10 is an end view of a package assembly in accordance with the present invention wherein an end of the outer package body has been removed to reveal the contents thereof.

From FIG. 10, it can be seen how, for shipping and storage, a plurality of food items, such as food items 11', can be placed within an inner receiving space 21 of an outer package body 22, along with a pair of microwave browning and crisping sleeves 1. Because the sleeves can be completely collapsed, in accordance with the present invention, into a flattened condition, they fit compactly into the receiving space 21, merely requiring an increase in the height thereof which is based solely upon the thickness of the paperboard utilized and independent of the peripheral profile of the product to be accommodated by the sleeves. Thus, the inclusion of the inventive microwave browning and crisping sleeves within the food package assembly poses no complicating factors.

Likewise, the method of microwave heating of packaged food via the inventive browning and crisping sleeve is also simple. The consumer has only to open the outer package body 22 and to remove the desired number of food items to be heated along with a corresponding number of sleeves. Thereafter, such as by pressing inwardly at a pair of opposed fold lines, the sleeve can be caused to erect itself into a configuration that is substantially matched to the peripheral profile of the food item so that the food item may then be slid into the receiving space (10, 10', 17) defined by the inner peripheral surface of the sleeve. Since the sleeve will inherently have a tendency to move back toward its collapsed configuration, no special efforts need be made to ensure that the microwave interactive layer of the browning and crisping sleeve will be brought as close as possible into contact with the peripheral surfaces of the food product. Once the food item is arranged within the sleeve, it is merely necessary to support them in a microwave oven and to activate the microwave oven so as to heat the food within the sleeve for an appropriate period of time. Any moisture that may be driven out of the food item during heating is free to escape out from the open ends of the sleeve.

Furthermore, it should be recognized that while various embodiments in accordance with the present invention have been described, the present invention will be susceptible to numerous other changes and modifications which will become apparent to those skilled in the art from the foregoing disclosure. Therefore, the present invention should not be considered to be limited to the details shown and described herein, but encompasses all such changes and modifications as are within the scope of the appended claims.

INDUSTRIAL APPLICABILITY

The present invention will find particular utility in the packaging of food for distribution and sale in refrigerated and frozen display cases of retail food stores. The browning and crisping sleeve is ideally suited for packaging due to its ability to be completely collapsed. Its adaptability to an infinite range of shapes and sizes of food products will make it especially useful in conjunction with a large number of those products that require browning or crisping about the full circumferential profile thereof, such as pocket pies, sandwiches and the like.

We claim:

1. A microwave browning and crisping sleeve comprising a paperboard strip and a microwave interactive layer affixed over one surface of said paperboard strip, said microwave interactive layer, when subjected to microwave energy, operating as a means for converting microwave energy to heat in an amount sufficient to brown or crisp food in heat transfer relationship therewith; wherein said paperboard strip is subdivided end-to-end by fold lines running side-to-side, into at least five panel portions extending across the width of the strip between opposite side edges thereof; wherein opposite ends of said paperboard strip are connected end-to-end in a manner creating a paperboard sleeve having the surface to which said interactive layer is affixed as an inner peripheral surface; and wherein said fold lines are disposed at positions enabling said sleeve to be erected and collapsed between a first configuration in which said sleeve is flattened for shipping and storage and a second configuration in which the inner peripheral surface defines an open-ended space for receiving a food product for heating in a microwave oven.

2. A microwave browning and crisping sleeve according to claim 1, wherein four of said fold lines are disposed to define, in said second configuration, a generally rectangular array, and wherein at least one additional fold line is disposed between a respective pair of said four fold lines.

3. A microwave browning and crisping sleeve according to claim 2, wherein said fold lines are formed by score lines.

4. A microwave browning and crisping sleeve according to claim 2, wherein said sleeve has one said additional fold line for enabling said second configuration to selectively be either of generally rectangular and wedge shapes.

5. A microwave browning and crisping sleeve according to claim 2, wherein said sleeve has two said additional fold lines for enabling said second configuration to selectively be any of generally rectangular, wedge and hexagonal shapes.

6. A microwave browning and crisping sleeve according to claim 1, wherein two of said fold lines are positioned relative to each other in a manner dividing said sleeve in half, the sum of the circumferential lengths of panel portions disposed between said two fold lines in one half of the sleeve being equal to the sum of the circumferential lengths of panel portions disposed between said two fold lines in an opposite half of the sleeve.

7. A microwave browning and crisping sleeve according to claim 6, wherein the number of panel portions between said two fold lines is the same in both circumferential directions, but the circumferential lengths of oppositely facing panel portions are unequal.

8. A microwave browning and crisping sleeve according to claim 7, wherein at least three panel portions are disposed between said two fold lines in each of said halves of the sleeve, and at least one of said at least three panel portions has a circumferential length that is different from the circumferential length of the other of said at least three panel portions.

9. A microwave browning and crisping sleeve according to claim 6, wherein the number of panel portions between said two fold lines is the same in both circumferential directions, but the circumferential lengths of oppositely facing panel portions are equal.

10. A microwave browning and crisping sleeve according to claim 9, wherein at least three panel portions are disposed between said two fold lines in each of said halves of the sleeve, and at least one of said at least three panel portions has a circumferential length that is different from the circumferential length of the other of said at least three panel portions.

11. A food package assembly for use in shipping, storing and microwave heating of food comprising:

(A) an outer package body defining an inner receiving space;

(B) at least one item of food; and (C) at least one microwave browning and crisping sleeve, said sleeve comprising a paperboard strip and a microwave interactive layer affixed over one surface of said paperboard strip, said microwave interactive layer, when subjected to microwave energy, operating as a means for converting microwave energy to heat in an amount sufficient to brown or crisp food in heat transfer relationship therewith; wherein said paperboard strip is subdivided end-to-end by fold lines running side-to-side, into at least five panel portions extending across the width of the strip between opposite side edges thereof; wherein opposite ends of said paperboard strip are connected end-to-end in a manner creating a paperboard sleeve having the surface to which said interactive layer is affixed as an inner peripheral surface; wherein said fold lines are disposed at positions enabling said sleeve to be erected and collapsed between a first configuration in which said sleeve is flattened for shipping and storage and a second configuration in which the inner peripheral surface defines an open-ended space for receiving a said food item with said inner peripheral surface being in heat transfer relationship to top, bottom and side surfaces thereof; and wherein said food item and sleeve are disposed within said receiving space with the sleeve being in said flattened first configuration.

12. A food package assembly according to claim 11, wherein said fold lines are formed by score lines.

13. A food package assembly according to claim 11, wherein said sleeve has one said additional fold line for enabling said second configuration to selectively be either of generally rectangular and wedge shapes.

14. A food package assembly according to claim 11, wherein said sleeve has two said additional fold lines for enabling said second configuration to selectively be any of generally rectangular, wedge and hexagonal shapes.

15. A food package assembly according to claim 11, wherein two of said fold lines are positioned relative to each other in a manner dividing said sleeve in half, the sum of the circumferential lengths of panel portions disposed between said two fold lines in one half of the sleeve being equal to the sum of the circumferential lengths of panel portions disposed between said two fold lines in an opposite half of the sleeve.

16. A food package assembly according to claim 15, wherein the number of panel portions between said two fold lines is the same in both circumferential directions, but the circumferential lengths of oppositely facing panel portions are unequal.

17. A food package assembly according to claim 16, wherein at least three panel portions are disposed between said two fold lines in each of said halves of the sleeve, and at least one of said at least three panel portions has a circumferential length that is different from the circumferential length of the other of said at least three panel portions.

18. A food package assembly according to claim 15, wherein the number of panel portions between said two fold lines is the same in both circumferential directions, but the circumferential lengths of oppositely facing panel portions are equal.

19. A food package assembly according to claim 18, wherein at least three panel portions are disposed between said two fold lines in each of said halves of the sleeve, and at least one of said at least three panel portions has a circumferential length that is different from the circumferential length of the other of said at least three panel portions.

20. A method of microwave heating packaged food comprising the steps of:

(A) providing a package assembly comprising:

(1) an outer package body defining an inner receiving space;

(2) at least one item of food; and (3) at least one microwave browning and crisping sleeve, said sleeve comprising a paperboard strip and a microwave interactive layer affixed over one surface of said paperboard strip, said microwave interactive layer, when subjected to microwave energy, operating as a means for converting microwave energy to heat in an amount sufficient to brown or crisp food in heat transfer relationship therewith; wherein said paperboard strip is subdivided end-to-end by fold lines running side-by-side, into at least five panel portions extending across the width of the strip between opposite side edges thereof; wherein opposite ends of said paperboard strip are connected end-to-end in a manner creating a paperboard sleeve having the surface to which said interactive layer is affixed as an inner peripheral surface;

wherein said fold lines are disposed at positions enabling said sleeve to be erected and collapsed between a first configuration in which said sleeve is flattened for shipping and storage and a second configuration in which the inner peripheral surface defines an open-ended space for receiving a said food item with said inner peripheral surface being in heat transfer relationship to top, bottom and side surfaces thereof; and wherein said food item and sleeve are disposed within said receiving space with the sleeve being in said flattened first configuration;

(B) opening the outer package body;

(C) removing a food item and a sleeve from the outer package body;

(D) erecting said sleeve into a said second configuration conforming generally to a peripheral profile of the removed food item;

(E) arranging said removed food item within said open-ended space with top, bottom and side surfaces of the food item in heat transfer relationship with respect to the inner peripheral surface of the sleeve;

(F) supporting the food item arranged within the sleeve in a microwave oven; and (G) heating the food within the sleeve in the microwave oven.

* * * * *